US005127632A

United States Patent [19]

Muschner et al.

[11] Patent Number: 5,127,632

[45] Date of Patent: Jul. 7, 1992

[54] GAS FLUSHING DEVICE INCLUDING PERFORATED BRICK AND GAS FLUSHING STONE ASSEMBLY

[75] Inventors: Udo Muschner, Tönisvorst; Manfred Winkelmann, Krefeld; Herbert Metzger, Duisburg; Hans Rothfuss, Taunusstein, all of Fed. Rep. of Germany

[73] Assignee: Didier-Werke AG, Wiesbaden, Fed. Rep. of Germany

[21] Appl. No.: 671,985

[22] Filed: Mar. 19, 1991

[30] Foreign Application Priority Data

Apr. 24, 1990 [DE] Fed. Rep. of Germany ..... 4012952

[51] Int. Cl.[5] ..... B22D 1/00

[52] U.S. Cl. ..... 266/226; 266/265

[58] Field of Search ..... 266/217, 220, 265

[56] References Cited

U.S. PATENT DOCUMENTS 4,695,043 9/1987 Winkelmann et al. ..... 266/265
4,711,432 12/1987 Heinz et al. ..... 266/220
4,978,108 12/1990 Rothfuss et al. ..... 266/220

FOREIGN PATENT DOCUMENTS 3633516 6/1987 Fed. Rep. of Germany .
3901926 12/1989 Fed. Rep. of Germany .
1175226 12/1969 United Kingdom ..... 266/220

*Primary Examiner*—Scott Kastler
*Attorney, Agent, or Firm*—Wenderoth, Lind & Ponack

[57] ABSTRACT

A gas flushing device includes a ceramic refractory perforated brick extended through a refractory lining of a wall of a metallurgical vessel. The perforated brick has an outer end having therein a recess opening outwardly of the vessel. A ceramic refractory gas flushing stone is fitted within such recess. The perforated brick has a portion that covers an inner end of the gas flushing stone and that projects therefrom inwardly beyond the vessel lining toward the vessel interior. The projecting portion of the perforated brick has a gas permeable region confronting the inner end of the gas flushing stone. As a result, gas passing through the gas flushing stone to the inner end thereof then passes through the gas permeable region of the projecting portion of the perforated brick into molten metal within the interior of the vessel.

30 Claims, 1 Drawing Sheet

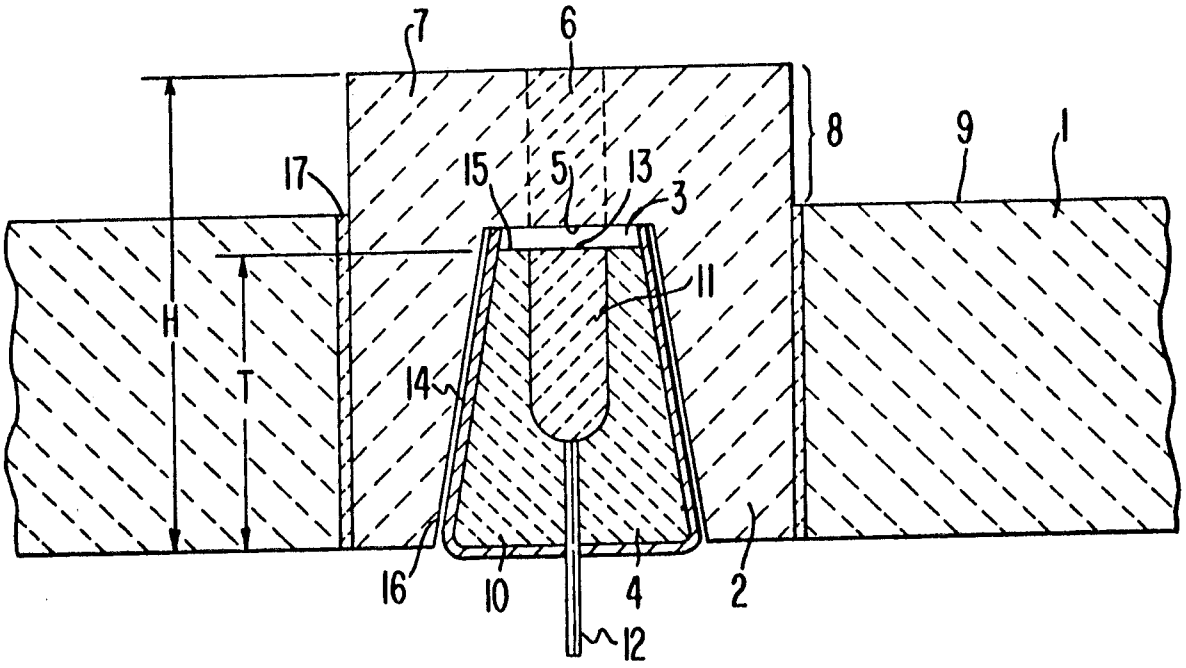
1
9
8
2
11
3
13
4
12
6
5
15
10
7
14
16
17
T
H

GAS FLUSHING DEVICE INCLUDING PERFORATED BRICK AND GAS FLUSHING STONE ASSEMBLY

BACKGROUND OF THE INVENTION

The present invention relates to a gas flushing device extending through a refractory lining of the wall of a metallurgical vessel for introducing gas into molten metal within the vessel. The present invention further is directed to an assembly of such gas flushing device with the refractory lining of the wall of the metallurgical vessel. Yet further, the present invention is directed to the individual components of such gas flushing device including a ceramic refractory perforated brick to be extended through the refractory lining, as well as a ceramic refractory gas flushing stone or stone assembly fitted within a recess in such perforated brick, an inner end of the gas flushing stone or stone assembly being shielded from the molten metal within the vessel by a portion of the perforated brick.

A gas flushing device is disclosed in German DE 36 33 516 C2 wherein two conical gas flushing stones are arranged one above the other in a bottom wall of a vessel. The upper gas flushing stone is fitted within the refractory lining of the vessel bottom. The lower gas flushing stone is arranged in a perforated brick. The upper gas flushing stone and the perforated brick are separate components, each of which must be fitted or assembled separately into the refractory lining.

German DE 39 01 926 C1 discloses a gas flushing device including a perforated brick within a refractory lining of a bottom wall of a vessel. A conical gas flushing stone is inserted within the perforated brick. Within the vessel interior, a wearable hood or cover that has a gas permeable central region is fitted from the top over the gas flushing stone or the perforated brick. The wearable hood or cover must be sealed with respect to the perforated brick at the vessel bottom. The wearable hood or cover also must be connected with the gas flushing stone. Actual construction or assembly of this arrangement is time consuming. Additionally, problems occur when the refractory lining in the region of the seal between the wearable hood or cover and the lining wears or the seal itself becomes abraded.

SUMMARY OF THE INVENTION

With the above discussion in mind, it is an object of the present invention to provide an improved gas flushing device whereby it is possible to overcome the above and other prior art disadvantages.

It is a further object of the present invention to provide such a gas flushing device having a simplified construction and that does not require replacement within a metallurgical vessel until such time as wear of the refractory lining of the wall of the vessel has progressed such that repair otherwise would be necessary. In other words, in accordance with this feature of the present invention, replacement of the gas flushing device itself can be forestalled until such time as other repairs of the refractory lining are required.

It is a still further object of the present invention to provide an assembly of such gas flushing device in combination with the refractory lining of the wall of the metallurgical vessel.

It is a still even further object of the present invention to provide the individual components of the such gas flushing device, including a novel perforated brick structure and a novel gas flushing stone or stone assembly structure.

The above objects are achieved in accordance with the present invention by the provision that the gas flushing device includes a ceramic refractory perforated brick extending through the refractory lining of the wall of the vessel, the perforated brick having therein a recess that opens outwardly of the vessel. A ceramic refractory gas flushing stone is fitted within this recess. A portion of the perforated brick inwardly of the inner end of the recess covers the gas flushing stone and isolates it from the molten metal within the vessel. This portion extends inwardly toward the interior of the vessel beyond the refractory lining thereof. This projecting portion of the perforated brick is gas permeable at least in a region thereof confronting the inner end of the gas flushing stone. Accordingly, gas that is passed through the gas flushing stone to the inner end thereof then passes through the gas permeable region of the projecting portion of the perforated brick and then into molten metal within the interior of the vessel.

The projecting portion of the perforated brick that extends into the vessel interior wears during operation. However, such projecting portion protects the gas flushing stone from wear. The brick or refractory lining in the vicinity of the perforated brick also wears during operation. Such wear of the refractory lining however is inevitable and always occurs. Further, such wear does not present any additional problems, since the perforated brick is sealed to the refractory lining. As a result, the perforated brick does not have to be replaced until the refractory lining has worn down to an extent such that maintenance or repair otherwise would be necessary in any event.

The gas permeability of the region of the projecting portion of the perforated brick can be achieved in a number of ways. For example, such region may be formed of gas porous ceramic refractory material. Also, the gas permeable region may be formed by capillaries extending through the projecting portion. Additionally, the gas permeable region may be formed of a gas permeable insert fitted in the projecting portion. Preferably, the gas permeable region is located centrally of the projecting portion, i.e. at a position confronting the gas exiting from the inner end of the gas flushing stone. This gas permeable region of the projecting portion of the perforated brick is surrounded or enclosed laterally by an annular gas impermeable region. Generally, the gas impermeable region will become worn less rapidly that will the gas permeable region.

A joint is formed between the exterior surface of the gas flushing stone and a surface of the perforated brick defining the recess therein. To avoid molten metal that may reach the gas flushing stone upon wearing away of the projecting portion of the perforated brick passing through such joint, a sheath, generally metal, of the gas flushing stone extends inwardly beyond the inner end of the gas flushing stone. This thereby avoids molten metal breakthrough at the joint between the gas flushing stone and the inner, recess-defining surface of the perforated brick. The inner end of the gas flushing stone generally is located outwardly of or level with an inner surface of the refractory lining of the vessel wall. A space is defined between the inner end of the gas flushing stone and a surface of the perforated brick defining an inner end of the recess therein. A gas permeable region of the projecting portion of the perforated brick extends from this space to an inner end of the projecting portion.

The dimension of the perforated brick from the outer end thereof to the inner end thereof is greater than the depth of the recess therein that is to receive the gas flushing stone.

BRIEF DESCRIPTION OF THE DRAWING

Other objects, features and advantages of the present invention will be apparent from the following detailed description of a preferred embodiment thereof, wherein:

The single drawing figure is a somewhat schematic cross sectional view through a portion of a refractory lining of a bottom wall of a metallurgical vessel equipped with a gas flushing device according to the present invention.

DETAILED DESCRIPTION OF THE INVENTION

In the drawing is shown a portion of a refractory lining 1 of a bottom wall of a metallurgical vessel. Lining 1 has an inner surface 9. A perforated brick 2 is formed of a ceramic refractory material and is cemented or mortared within a opening through lining 1 as at 17. Perforated brick 2 has an inner end, i.e. the upper end shown in the drawing, that is directed toward the interior of the metallurgical vessel and that is exposed to the molten metal therein, as well as an outer end, i.e. the lower end shown in the drawing. The outer end of the perforated brick has therein a recess 3 that extends toward the inner end of perforated brick 2 but stops short thereof at an inner surface or base 5 of recess 3.

A gas flushing stone assembly including a gas flushing stone 4 and a surrounding sheath 14, for example of metal, fits within recess 3. The stone 4 is formed of ceramic refractory material and may be of various configurations. In the illustrated configuration, the stone 4 is formed of a gas impermeable portion 10 having therein a recess within which is fitted a gas permeable portion 11 that is directed toward the vessel interior. A gas pipe 12 extends to gas permeable portion 11 so that gas may be supplied thereto. A space is defined between inner end surface 15 of stone 4 and inner surface 5 of recess 3. Thus, there is defined a gas outlet zone 13 from gas permeable portion 11 into such space.

Perforated brick 2 has a portion 8 that covers the gas flushing stone 4 and projects therefrom inwardly toward the interior of the vessel and beyond lining 1. In the illustrated arrangement, projecting portion 8 extends upwardly beyond inner surface 9 of lining 1. Inner surface 5 of recess 3 is illustrated to be below surface 9 but additionally could lie in the same plane as surface 9.

Projecting portion 8 is gas permeable at least in a region thereof confronting the inner end of the gas flushing stone 4. In the illustrated arrangement, projecting portion 8 is provided with a gas permeable region 6 confronting and dimensioned to the gas outlet zone 13 of stone 4. Gas permeable zone 6 extends from surface 5 to the inner, i.e. upper, end surface of perforated brick 2. As a result, gas passed from pipe 12 and through gas permeable portion 11 and exiting outlet zone 13 then passes through gas permeable region 6 of the projecting portion 8 of the perforated brick 2 into molten metal within the interior of the vessel.

In the illustrated arrangement, gas permeable region 6 is located centrally of projecting portion 8 and is surrounded by an annular gas impermeable portion 7 of perforated brick 2. Gas permeable region 6 may comprise gas porous ceramic refractory material, capillaries extending through projecting portion 8, or a gas permeable insert fitted in projecting portion 8. The height H of perforated brick 2 is greater than the depth of recess 3 or the height T of gas flushing stone 4.

During operation, the projecting portion 8 progressively will wear, but during such operation the gas flushing stone is protected from the molten metal. At such time as the projection portion 8 is worn away, molten metal will break through into the space at the upper end of stone 4. At such time it is necessary avoid molten metal breakthrough along joint 16 between the interior surface of perforated brick 2 and the exterior surface of the gas flushing stone assembly. This is achieved by extending upwardly the sheath 14 beyond the inner end 15 of stone 4. Thus, molten metal cannot reach joint 16. Alternatively, joint 16 could be protected by a peripheral annular edge at inner end 15. During operation, projecting portion 8 of brick 2 will wear first, and central zone 6 will wear more rapidly than annular zone 7. By the arrangement of the present invention, faster wear of the perforated brick than of the lining 1 is made possible by the provision of projecting portion 8. This prevents failure of the gas flushing device before repair or maintenance of the lining 1 otherwise would be necessary. Normal wear of lining 1 occurs, but this provides no disadvantage because the seal at region 17 is maintained as a result of the wear of perforated brick 2 being primarily at projecting portion 8.

The end result of this construction is that when perforated brick 2 is worn down to gas flushing stone 4, such that the gas flushing device must be replaced, lining 1 also will have become worn to an extent such that repair of lining 1 also is necessary. The gas flushing device will be replaced at this time. As a result, the present invention makes it possible to eliminate additional down time other than that that would be necessary for repair of lining 1 due to normal wear thereof. When replacement of perforated brick 2 becomes necessary, gas flushing stone 4 also will be replaced.

Although the present invention has been described and illustrated with respect to preferred features thereof, it is to be understood that various changes and modifications may be made to the specifically described and illustrated features without departing from the scope of the present invention. Particularly, whereas gas permeable region 6 is illustrated as being cylindrical, it could be of other configurations, for example is could expand upwardly or inwardly of the metallurgical vessel.

We claim:

1. In an assembly of a refractory lining of a wall of a metallurgical vessel, a gas flushing device extending through said lining for introducing a gas into molten metal to be within the vessel, the improvement wherein said gas flushing device comprises:

a ceramic refractory perforated brick extending through said lining, said perforated brick having therein a recess open outwardly of the vessel;

a ceramic refractory gas flushing stone positioned with a major portion thereof fitted within said recess;

said perforated brick having a portion covering an inner end of said gas flushing stone and projecting therefrom inwardly beyond said lining toward the vessel interior; and said projecting portion of said perforated brick being gas permeable at least in a region thereof confronting said inner end of said gas flushing stone, whereby gas passed through said gas flushing stone to said inner end thereof then passes through said gas permeable region of said projecting portion of said perforated brick into the interior of the vessel.

2. The improvement claimed in claim 1, wherein said gas permeable region comprises gas porous ceramic refractory material.

3. The improvement claimed in claim 1, wherein said gas permeable region is formed by capillaries extending through said projecting portion.

4. The improvement claimed in claim 1, wherein said gas permeable region comprises a gas permeable insert fitted in said projecting portion.

5. The improvement claimed in claim 1, wherein said gas permeable region is located centrally of said projecting portion and is surrounding by an annular gas impermeable region.

6. The improvement claimed in claim 1, wherein said gas permeable region is located inwardly only of that portion of said inner end of said gas flushing stone from which gas passes.

7. The improvement claimed in claim 1, further comprising a joint between said gas flushing stone and a surface of said perforated brick defining said recess, and means for isolating said joint from said gas permeable region.

8. The improvement claimed in claim 7, wherein said isolating means comprises a sheath of said gas flushing stone extending inwardly beyond said inner end of said gas flushing stone.

9. The improvement claimed in claim 1, wherein said inner end of said gas flushing stone is located outwardly of an inner surface of said lining.

10. The improvement claimed in claim 1, further comprising a space between said inner end of said gas flushing stone and a surface of said perforated brick defining an inner end of said recess.

11. The improvement claimed in claim 10, wherein said gas permeable region extends from said space to an inner end of said projecting portion.

12. The improvement claimed in claim 1, wherein said gas flushing stone comprises a gas impermeable portion having therein a recess opening inwardly of the vessel, a gas permeable portion filling said recess, a sheath surrounding said gas impermeable portion except for said inner end, and gas supply means extending through said sheath to said gas permeable portion.

13. A gas flushing device to be positioned to extend through a wall of a metallurgical vessel for introducing a gas into molten metal to be within the vessel, said gas flushing device comprising:

a ceramic refractory perforated brick to be positioned to extend through a refractory lining of the vessel wall, said perforated brick having an outer end having therein a recess to be open outwardly of the vessel;

a ceramic refractory gas flushing stone positioned with a major portion thereof fitted within said recess;

said perforated brick having a portion covering an inner end of said gas flushing stone and projecting therefrom in a direction to be inwardly beyond the vessel lining toward the vessel interior; and said projecting portion of said perforated brick being gas permeable at least in a region thereof confronting said inner end of said gas flushing stone, whereby gas passed through said gas flushing stone to said inner end thereof passes through said gas permeable region of said projecting portion of said perforated brick.

14. A device as claimed in claim 13, wherein said gas permeable region comprise gas porous ceramic refractory material.

15. A device as claimed in claim 13, wherein said gas permeable region is formed by capillaries extending through said projecting portion.

16. A device as claimed in claim 13, wherein said gas permeable region comprises a gas permeable insert fitted in said projecting portion.

17. A device as claimed in claim 13, wherein said gas permeable region is located centrally of said projecting portion and is surrounded by an annular gas impermeable region.

18. A device as claimed in claim 13, wherein said gas permeable region is located inwardly only of that portion of said inner end of said gas flushing stone from which gas is to pass.

19. A device as claimed in claim 13, further comprising a joint between said gas flushing stove, and a surface of said perforated brick defining said recess, and means for isolating said joint from said ga permeable region.

20. A device as claimed in claim 19, wherein said isolating means comprises a sheath of said gas flushing stone extending inwardly beyond said inner end of said gas flushing stone.

21. A device as claimed in claim 13, further comprising a space between said inner end of said gas flushing stone and a surface of said perforated brick defining an inner end of said recess.

22. A device as claimed in claim 21, wherein said gas permeable region extends from said space to an inner end of said projecting portion.

23. A device claimed in claim 13, wherein said gas flushing stone comprises a gas impermeable portion having therein a recess opening in a direction to be inwardly of the vessel, a gas permeable portion filling said recess, a sheath surrounding said gas impermeable portion except for said inner end, and gas supply means extending through said sheath to said gas permeable portion.

24. A ceramic refractory perforated brick to be positioned to extend through a refractory lining of a wall of a metallurgical vessel and for use in mounting a gas flushing stone to form a gas flushing device for introducing a gas into molten metal to be within the vessel, said perforated brick comprising:

an inner end to be directed toward the interior of the vessel and an outer end to be directed outwardly of the vessel;

a recess for receipt of a gas flushing stone, said recess opening on said outer end and extending inwardly therefrom in a direction toward said inner end to an inner surface defining an inner end of said recess, the depth of said recess to said inner surface being less than the dimension of said perforated brick from said outer end thereof to said inner end thereof; and said perforated brick being gas impermeable except for a gas permeable region thereof extending from said inner surface to said inner end.

25. A perforated brick as claimed in claim 24, wherein said gas permeable region comprises gas porous ceramic refractory material.

26. A perforated brick as claimed in claim 24, wherein said gas permeable region is formed by capillaries extending through said portion.

27. A perforated brick as claimed in claim 24, wherein said gas permeable region comprises a gas permeable insert fitted in said portion.

28. A perforated brick as claimed in claim 24, wherein said gas permeable region is located centrally of said portion and is surrounded by an annular gas impermeable region.

29. A gas flushing stone assembly to be fitted within a recess in a perforated brick to form a gas flushing device to be positioned to extend through a refractory lining of a wall of a metallurgical vessel for introducing a gas into molten metal to be within the vessel, said gas flushing stone assembly comprising:

a ceramic refractory stone having an inner end to be directed toward the vessel and an outer end to be directed outwardly of the vessel, at least a portion of at least part of said inner end of said stone being gas permeable; and a sheath enclosing said stone except for an inner end surface of said inner end thereof, said sheath including an inner end portion extending beyond said inner end surface of said stone.

30. An assembly claimed in claim 29, wherein said stone comprises a gas impermeable portion having therein a recess to be directed inwardly of the vessel, a gas permeable portion filling said recess, said sheath surrounding said gas impermeable portion except for said inner end surface, and gas supply means extending through said sheath to said gas permeable portion.

* * * * *